US005125030A

United States Patent [19]

Nomura et al.

[11] Patent Number: 5,125,030

[45] Date of Patent: Jun. 23, 1992

[54] SPEECH SIGNAL CODING/DECODING SYSTEM BASED ON THE TYPE OF SPEECH SIGNAL

[75] Inventors: Takahiro Nomura; Yohtato Yatsuzuka, both of Tokyo; Shigeru Iizuka, Saitama, all of Japan

[73] Assignee: Kokusai Denshin Denwa Co., Ltd., Tokyo, Japan

[21] Appl. No.: 641,634

[22] Filed: Jan. 17, 1991

Related U.S. Application Data

[63] Continuation of Ser. No. 456,598, Dec. 29, 1989, abandoned, which is a continuation of Ser. No. 265,639, Oct. 31, 1989, abandoned.

[30] Foreign Application Priority Data

Apr. 13, 1987 [JP] Japan ..... 63-88922

[51] Int. Cl.[5] ..... G10L 3/02

[52] U.S. Cl. ..... 381/31; 381/30; 381/47

[58] Field of Search ..... 381/29-41, 381/51-53; 364/513.5, 724.19, 724.2, 724.15; 375/25-27, 34, 122

[56] References Cited

U.S. PATENT DOCUMENTS

| | | | |
|---|---|---|---|
| 4,617,676 | 10/1986 | Jayant et al. | 381/31 |
| 4,726,037 | 2/1988 | Jayant | 381/30 |
| 4,757,517 | 7/1988 | Yatsuruka | 375/122 |
| 4,797,925 | 1/1989 | Lin | 381/31 |
| 4,811,396 | 3/1989 | Yatsuzuka | 381/38 |

FOREIGN PATENT DOCUMENTS 2150377 6/1985 United Kingdom .

OTHER PUBLICATIONS

Ramamoorthy et al., "Enhancement of ADPCM Speech by Adaptive Postfiltering", ATT&T BLTJ, vol. 63, No. 8, Oct. 1984, pp. 1465-1475.

Adaptive Postfiltering of 16kb/s ADPCM Speech, IEEE 1986, pp. 829-832, N. S. Jayant et al.

*Primary Examiner*—Dale M. Shaw
*Assistant Examiner*—Michelle Doerrler
*Attorney, Agent, or Firm*—Armstrong & Kubovcik

[57] ABSTRACT

An input speech signal is encoded by an adaptive quantizer which quantizes the predicted residual signal between the digital input speech signal, and prediction signals provided by predictors and a shaped quantization noise provided by a noise shaping filter. An inverse quantizer, to which the encoded speech signal is supplied, is provided for noise shaping and local decoding. A noise shaping filter makes the spectrum of the quantization noise similar to that of the original digital input speech signal by using the shaping factors. The shaping factors are changed depending upon the prediction gain (ex. ratio of input speech signal to predicted residual signal or the prediction coefficients). On a decoding side of the system there are an inverse quantizer, predictors, and a post noise shaping filter. The shaping factors for the post noise shaping filter are similarly changed depending upon the prediction gain.

9 Claims, 6 Drawing Sheets

SPEECH SIGNAL CODING/DECODING SYSTEM BASED ON THE TYPE OF SPEECH SIGNAL

This application is a continuation of application Ser. No. 456,598, filed Dec. 29, 1989 which is a continuation of application Ser. No. 265,639 filed Oct. 31, 1988 both now abandoned.

BACKGROUND OF THE INVENTION

The present invention relates to a speech signal coding/decoding system, in particular, relates to such a system which codes or decodes a digital speech signal with a low bit rate.

A communication system with severe limitation in the frequency band and/or transmit power, such as a digital marine satellite communication and digital business satellite communication using SCPC (single channel per carrier) is desired to have a speech coding/decoding system with a low bit rate, excellent speech quality, and low error rate.

There are a number of conventional coding/decoding systems adaptive prediction coding system (APC) has a predictor for calculating the prediction coefficient for every frame, and an adaptive quantizer for coding the predicted residual signal which is free from correlation between sampled value. A multi-pulse drive linear prediction coding system (MPEC) excites an LPC synthesis filter with a plurality of pulse sources, and so on.

The prior adaptive prediction coding system (APC) is now described as an example.

FIG. 1A is a block diagram of a prior coder for adaptive prediction coding system, which is shown in U.S. Pat. No. 4,811,396, and UK patent No. 2150377. A digital input speech signal $S_j$ is fed to the LPC analyzer 2 and the short term predictor 6 through the input terminal 1. The LPC analyzer 2 carries out the short term spectrum analysis for every frames according to the digital input speech signal. Resultant LPC parameters thus obtained are coded in the LPC parameter coder 3. The coded LPC parameters are transmitted to a receiver side through a multiplex circuit 30. The LPC parameter decoder 4 decodes the output of the LPC parameter coder 3, and the LPC parameter/short term prediction parameter converter 5 provides the short term prediction parameter, which is applied to the short term predictor 6, the noise shaping filter 19, and the local decoding short term predictor 24.

The subtractor 11 subtracts the output of the short term predictor 6 from the digital input speech signal $S_j$ and provides the short term predicted residual signal $\Delta S_j$ which is free from correlation between adjacent samples of the speech signal. The short term predicted residual signal $\Delta S_j$ is fed to the pitch analyzer 7 and the long term predictor 10. The pitch analyzer 7 carries out the pitch analysis according to the short term predicted residual signal $\Delta s_j$ and provides the pitch period and the pitch parameter which are coded by the pitch parameter coder 8 and are transmitted to a receiver side through the multiplex circuit 30. The pitch parameter decoder 9 decodes the pitch period and the pitch parameter which are the output of the coder 8. The output of the decoder 9 is sent to the long term predictor 10, the noise shaping filter 19 and the local decoding long term predictor 23.

The subtractor 12 subtracts the output of the long term predictor 10, which uses the pitch period and the pitch parameter, from the short term predicted residual signal $\Delta s_j$, and provides the long term predicted residual signal, which is free from the correlation of repetitive waveforms by the pitch of speech signal and ideally is a white noise. The subtractor 17 subtracts the output of the noise shaping filter 19 from the long term predicted residual signal which is the output of the subtractor 12, and provides the final-predicted residual signal to the adaptive quantizer 16. The quantizer 16 performs the quantization and the coding of the final predicted residual signal and transmits the coded signal to the receiver side through the multiplex circuit 30.

The coded final predicted residual signal, which is the output of the quantizer 16, is fed to the inverse quantizer 18 for decoding and inverse quantizing. The output of the inverse quantizer 18 is fed to the subtractor 20 and the adder 21. The subtractor 20 subtracts the final predicted residual signal, which is the input of the adaptive quantizer 16, from said quantized final predicted residual signal which is the output of the inverse quantizer 18, and provides the quantization noise, which is fed to the noise shaping filter 19.

In order to update the quantization step size in every sub-frame, the RMS calculation circuit 13 calculates the RMS (root mean square) of said long term predicted residual signal. The RMS coder 14 codes the output of the RMS calculator 13, and stores the coded output level as a reference level along with the adjacent levels made from it. The output of the RMS coder 14 is decoded in the RMS decoder 15. Multiplication of the quantized RMS value corresponding to the reference level as the reference RMS value, by the predetermined fundamental step size makes the step size of the adaptive quantizer 16.

On the other hand, the adder 21 adds the quantized final predicted residual signal which is the output of the inverse quantizer 18, to the output of the local decoding long term predictor 23. The output of the adder 21 is fed to the long term predictor 23 and the adder 22, which also receives the output of the local decoding short term predictor 24. The output of the adder 22 is fed to the local decoding short term predictor 24.

The local decoded digital input speech signal $S_j$ is obtained through the above process on terminal 25.

The subtractor 26 provides the difference between the local decoded digital input speech signal $S_j$ and the original digital input speech signal $S_j$. The minimum error power detector 27 calculates the power of the error which is the output of the subtractor 26 over the sub-frame period. The similar operation is carried out for all the stored fundamental step sizes, and the adjacent levels. The RMS step size selector 28 selects the coded RMS level and the fundamental step size which provide the minimum power among error powers. The selected step size is coded in the step size coder 29. The output of the step size coder 29 and the selected coded RMS level are transmitted to the receiver side through the multiplexer 30.

FIG. 1B shows a block diagram of a decoder which is used in a prior adaptive prediction coding system on a receiver side.

The input signal at the decoder input terminal 32 is separated in the demultiplexer 33 into each information of the final residual signal (a), an RMS value (b), a step size (c), an LPC parameter (d), and a pitch period/pitch parameter (e). They are fed to the adaptive inverse quantizer 36, the RMS decoder 35, the step size decoder 34, the LPC parameter decoder 38, and the pitch parameter decoder 37, respectively.

The RMS value decoded by the RMS value decoder 35, and the fundamental step size obtained in the step size decoder 34 are set to the adaptive inverse quantizer 36. The inverse quantizer 36 inverse quantizes the received final predicted residual signal, and provides the quantized final predicted residual signal.

The short term prediction parameter obtained in the LPC parameter decoder 38 and the LPC parameter/short term prediction parameter converter 39 is sent to the short term predictor 43 which is one of the synthesis filters, and to the post noise shaping filter 44. Furthermore, the pitch period and the pitch parameter obtained in the pitch parameter decoder 37 are sent to the long term predictor 42, which is the other element of the synthesis filters.

The adder 40 adds the output of the adaptive inverse quantizer 36 to the output of the long term predictor 42, and the sum is fed to the long term predictor 42. The adder 41 adds the sum of the adder 40 to the output of the short term predictor 43, and provides the reproduced speech signal. The output of the adder 41 is fed to the short term predictor 43, and the post noise shaping filter 44 which shapes the quantization noise. The output of the adder 41 is further fed to the level adjuster 45, which adjusts the level of the output signal by comparing the level of the input with that of the output of the post noise shaping filter 44.

The noise shaping filter 19 in the coder, and the post noise shaping filter 44 in the decoder are now described.

FIG. 2 shows a block diagram of the prior noise shaping filter 19 in the coder. The output of the LPC parameter/short term prediction parameter converter 5 is sent to the short term predictor 49, and the pitch parameter and the pitch period which are the outputs of the pitch parameter decoder 9 are sent to the long term predictor 47. The quantization noise which is the output of the subtractor 20 is fed to the long term predictor 47. The subtractor 48 provides the difference between the input of the long term predictor 47 (quantization noise) and the output of the long term predictor 47. The output of the subtractor 48 is fed to the short term predictor 49. The adder 50 adds the output of the short term predictor 49 to the output of the long term predictor 47, and the output of the adder 50 is fed to the subtractor 17 as the output of the noise shaping filter 19.

The transfer function F'(z) of the noise shaping filter 19 is as follows.

$$F'(z)=r_{nl}P_l(z)+[l-r_{nl}P_l(z)]P_s(z/(r_s r_{ns})) \quad (1)$$

where $P_s(z)$ and $P_l(z)$ are transfer functions of the short term predictor 6 and the long term predictor 10, respectively, and are given for instance by the equations (2) and (3), respectively, described later. $r_s$ is leakage, $r_{nl}$ and $r_{ns}$ are noise shaping factors of the long term predictor and the short term predictor, respectively, and each satisfying $0 \leqq r_s, r_{nl}, r_{ns} \leqq 1$. The values of $r_{nl}$ and $r_{ns}$ are fixed in a prior noise shaping filter.

The transfer function Ps(z) of the short term predictor 6 is given below.

$$P_s(z) = \sum_{i=1}^{N_s} a_i z^{-1} \quad (2)$$

where $a_i$ is a short term prediction parameter, $N_s$ is the number of taps of a short term predictor. The value $a_i$ is calculated in every frame in the LPC analyzer 2 and the LPC parameter/short term prediction parameter converter 5. The value $a_i$ varies adaptively in every frame depending upon the change of the spectrum of the input signal.

The transfer function of the long term predictor 10 is defined by the similar equation, and the transfer function $P_l(z)$ for one tap predictor is as follows.

$$P_l(z)=b_l z^{-(P_p)} \quad (3)$$

where $b_l$ is the pitch parameter, $P_p$ is the pitch period. The values $b_l$ and $P_p$ are calculated in every frame in the pitch analyzer 7, and follows adaptively to the change of the periodicity of the input signal.

FIGS. 3A and 3B show block diagrams of the prior post noise shaping filter 44 in the decoder.

In a prior art, only a short term post noise shaping filter which has the weight of the short term prediction parameter in the equation (2) is used.

FIG. 3A shows a post noise shaping filter composed of merely a pole filter. The short term prediction parameter obtained in the LPC parameter/short term prediction parameter converter 39 is set to the short term predictor 52. The adder 51 adds the reproduced speech signal from the adder 41 to the output of the short term predictor 52, and the sum of the adder 51 is fed to the short term predictor 52 and the level adjuster 45. The transfer function $F_p'(z)$ of the post noise shaping filter including the level adjuster 45 is shown below.

$$F_p'(z) = \frac{G_0}{1 - P_s(z/r_s r_{ps})} \quad (4)$$

where $G_0$ is a gain control parameter, $r_{ps}$ is a shaping factor satisfying $0 \leqq r_{ps} \leqq 1$.

FIG. 3B shows another post noise shaping filter which has a zero filter together with the structure of FIG. 3A. The short term prediction parameter obtained in the LPC parameter/short term prediction parameter converter 39 is set to the pole filter 54 and the zero filter 55 of the short term predictor. The adder 53 adds the reproduced speech signal from the adder 41 to the output of the pole filter 54, and the sum is fed to the pole filter 54 and the zero filter 55. The subtractor 56 subtracts the output of the zero filter 55 from the output of the adder 53, and the difference is fed to the level adjuster 45.

The transfer function $F_{po}'(z)$ of the post noise shaping filter of FIG. 3B including the level adjuster 45 is shown below.

$$F_{po}'(z) = \frac{G_0[1 - P_s(z/r_s r_{psz})]}{[1 - P_s(z/r_s r_{psp})} \quad (5)$$

where $G_0$ is a gain control parameter, $r_{psz}$ and $r_{psp}$ are shaping factors of zero and pole filters, respectively, satisfying $0 \leqq r_{psz} \leqq 1$, and $0 \leqq r_{psp} \leqq 1$.

The noise shaping filter 19 in a prior coder is based upon a prediction filter which shapes the spectrum of the quantization noise similar to that of a speech signal, and masks the noise by a speech signal so that audible speech quality is improved. It is effective in particular to reduce the influence by quantization noise which exists far from the formant frequencies (in the valleys of the spectrum).

However, it should be appreciated that the spectrum of speech signal fluctuates in time, and thus has a feature depending upon voiced sound or non-voiced sound. A prior noise shaping filter does not depend on the feature of a speech signal, and merely applies fixed shaping factors. Therefore, when the shaping factors are the best for non-voiced sound, the voiced sound is distorted or not clear. On the other hand, when the shaping factors are the best for voiced sound, it does not noise-shape satisfactorily for non-voiced speech. Therefore, a prior fixed shaping factors cannot provide excellent speech quality for both voiced sound and non-voiced sound.

Further, the post noise shaping filter 44 in a prior decoder consists of only a short term predictor which emphasizes the speech energy in the vicinities of formant frequencies (at the peaks of the spectrum), that is, it spread the difference between the level of speech at the peaks and that of noise in the valleys. This is why speech quality is improved by the post noise shaping filter on a frequency domain. A prior post noise shaping filter also takes a fixed weight to a short term prediction filter without considering the feature of the spectrum of a speech signal. Thus, a strong noise-shaping, which is suitable to non-voiced sound, would provide undesirable click or distortion for voiced sound. On the other hand, the noise-shaping suitable for voiced sound is not satisfactory with non-voiced sound. Therefore, the post noise shaping filter with fixed shaping factors can not provide satisfactory speech quality for both voiced sound and non-voiced sound.

Also, on a transmitter side, a prior MPEC system has an weighting filter which determines amplitude and location of a excitation pulse so that the power of the difference between the input speech signal and the reproduced speech signal from a synthesis filter becomes minimum. The weighting filter also has a fixed weighting coefficient. Therefore, similar to the previous reason, it is not possible to obtain satisfactory speech quality for both voiced sound and non-voiced sound.

SUMMARY OF THE INVENTION

It is an object, therefore, of the present invention to overcome the disadvantages and limitations of a prior speech signal coding/decoding system by providing an improved speech signal coding/decoding system.

It is also an object of the present invention to provide a speech signal coding/decoding system which provides excellent speech quality irrespective of voiced sound or non-voiced sound.

It is also an object of the present invention to provide a noise shaping filter and a post noise shaping filter for a speech signal coding/decoding system so that excellent speech is obtained irrespective of voiced sound or non-voiced sound.

The above and other objects are attained by a speech coding/decoding system comprising; a coding side (FIG. 1A) comprising; a predictor (6,10) for providing a predicted signal of a digital input signal according to a prediction parameter provided by a prediction parameter device (2,3,4; 7,8,9), a quantizer (16) for quantizing a residual signal which is the difference between the predicted signal, and the digital input speech signal and the shaped quantization noise, an inverse quantizer (18) for inverse quantization of the output of said quantizer (16), a subtractor (20) for providing quantization noise which is a difference between an input of the quantizer (16) and an output of the inverse quantizer (18), a noise shaping a filter (19) for shaping spectrum of the quantization noise similar to that of an digital input signal according to the prediction gain, a multiplexer (30) for multiplexing quantized predicted residual signal at the output of the quantizer (16), and side information for sending to a receiver side; and a decoding side (FIG. 1B) comprising; a demultiplexer (33) for separating a quantized predicted residual signal and side information, an inverse quantizer (36) for inverse quantization and decoding of the quantized predicted residual signal from the transmitter side, a synthesis filter (42,43) for reproducing the digital input signal by adding an output of the inverse quantizer (36) and reproduced predicted signal, a post noise shaping filter (44) for reducing the perceptual effect of the quantization noise on the reproduced digital signal according to the prediction parameter; wherein the prediction parameter sent to the noise shaping filter (19), and the post noise shaping filter (44) is adaptively weighted depending upon the prediction gain.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Now, the embodiments of the present invention, in particular, a noise shaping filter in a coder and a post noise shaping filter in a decoder, are described.

Figure 1A:
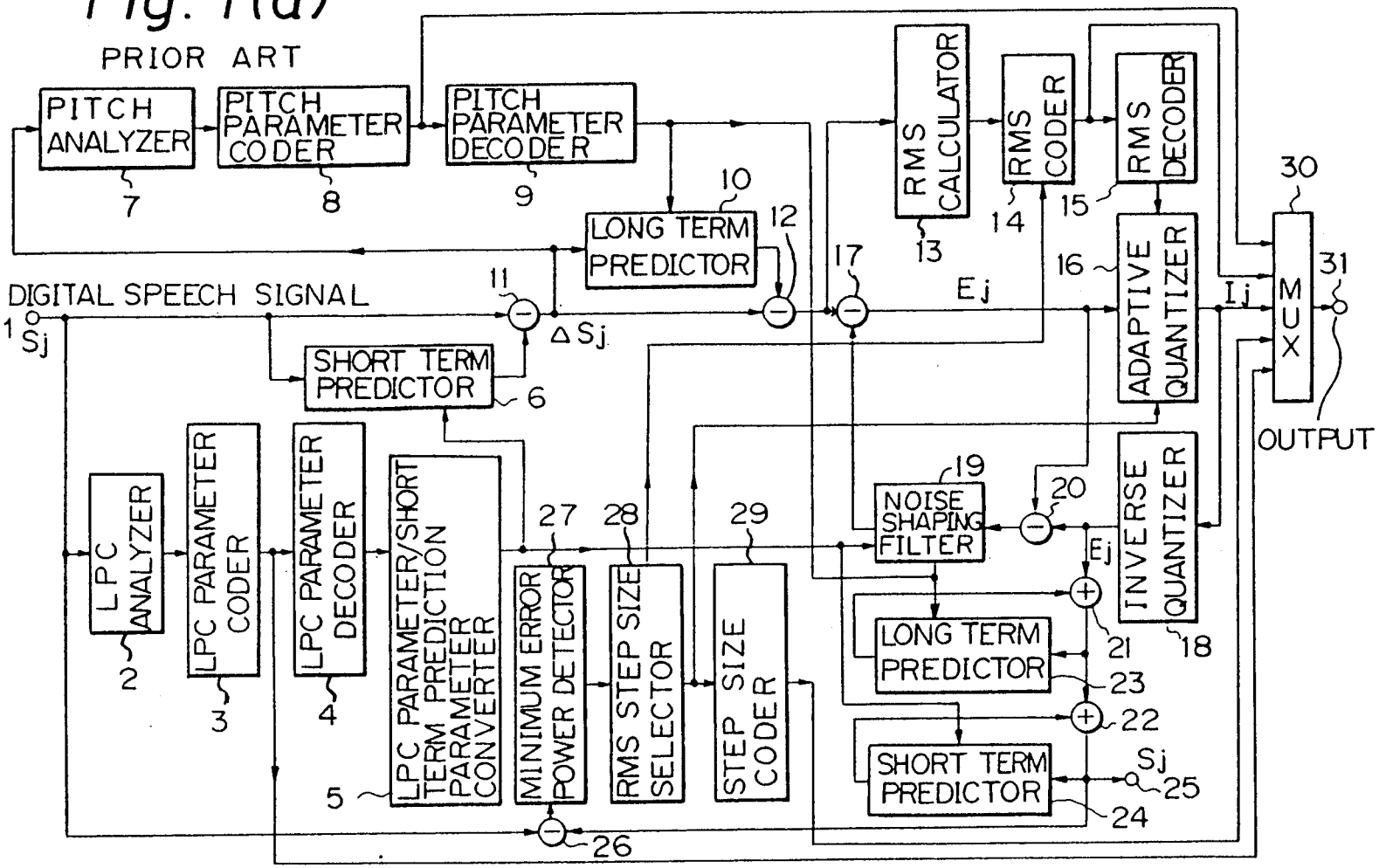
Fig. 1(a) PRIOR ART
FIG. 1A is a block diagram of a prior speech signal coder.
Figure 4:
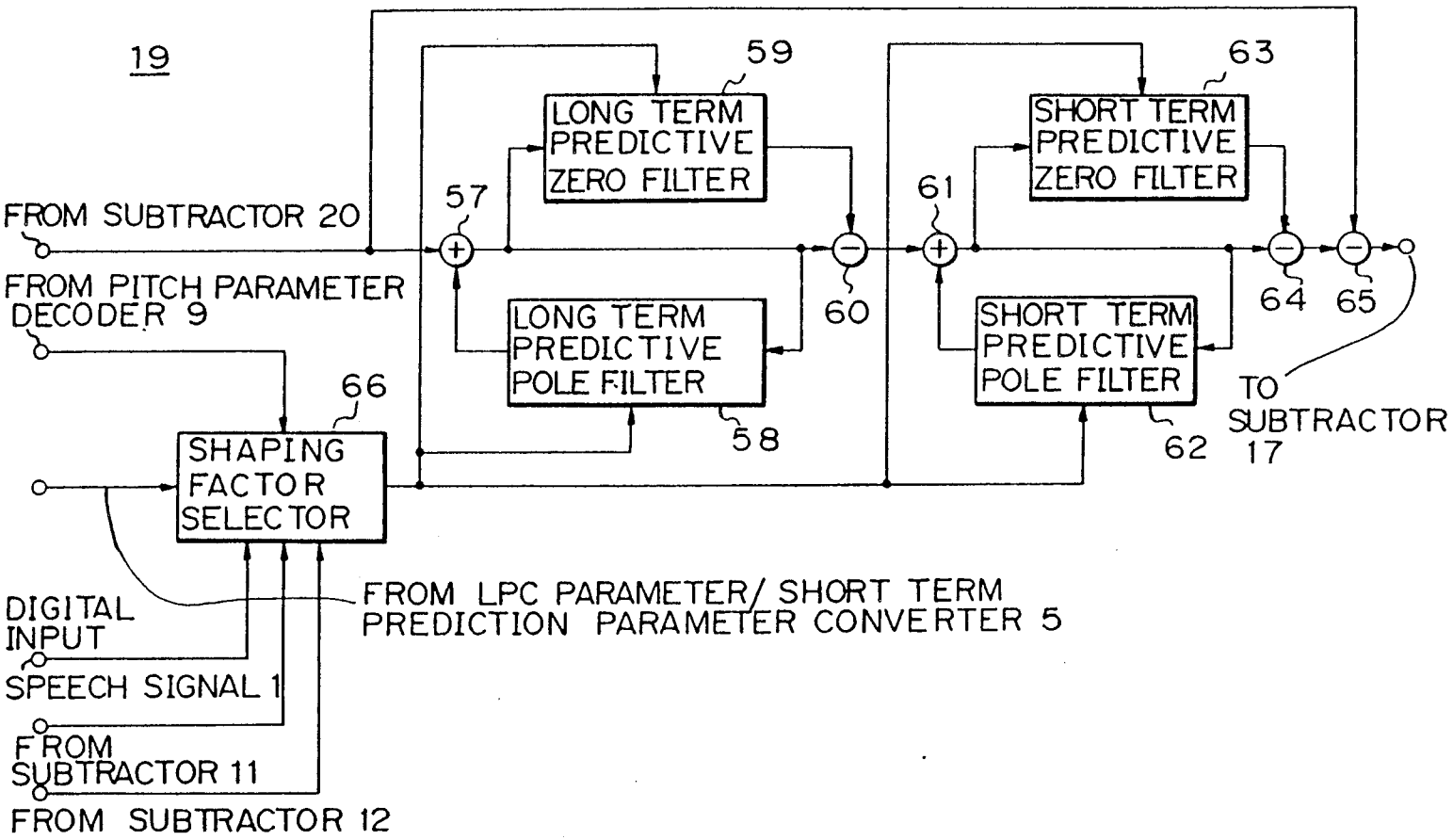
FIG. 4 is a block diagram of a noise shaping filter for a coder according to the present invention.

FIG. 4 shows a block diagram of a noise shaping filter according to the present invention. The shaping factor selector 66 receives the digital input signal from the coder input 1, the short term predicted residual signal from the subtractor 11, and the long term predicted residual signal from the subtractor 12, and evaluates the prediction gain by using those input signals. Then, the selector 66 weights adaptively the short term prediction parameter from the LPC parameter/short term prediction parameter converter 5, and the pitch parameter from the pitch parameter decoder 9 by using the result of the evaluation. Then, these weighted parameters are sent to the short term predictive pole filter 62, the short term predictive zero filter 63, the long term predictive pole filter 58, and the long term predictive zero filter 59. The adder 57 adds the quantization noise from the subtractor 20 and the output of the long term predictive pole filter 58, and the sum is fed to the long term predictive pole filter 58 and the long term predictive zero filter 59. The subtractor 60 subtracts the output of the long term predictive zero filter 59 from the output of the adder 57, and the difference, which is the output of the subtractor 60, is fed to the adder 61. The adder 61 adds the output of the subtractor 60 to the output of the short term predictive pole filter 62. The sum, which is the output of the adder 61, is fed to the short term predictive pole filter 62 and the short term predictive zero filter 63. The subtractor 64 subtracts the output of the short term predictive zero filter 63 from the output of the adder 61. The subtractor 65 subtracts the output of the subtractor 64 from the quantization noise which is the input of the noise shaping filter 19, and the difference, which is the output of the subtractor 65, is fed to the subtractor 17 (FIG. 1A) as the output of the noise shaping filter 19.

The transfer function F(z) of the noise shaping filter of FIG. 4 is shown as follows.

$$F(z) = 1 - \frac{1 - P_s(z/r_s)}{1 - P_s(z/r_s r_{ns})} \cdot \frac{1 - P_l(z)}{1 - r_{nl} \cdot P_l(z)} \quad (6)$$

The noise shaping filter 19 composes the long term predictive pole filter 58, the long term predictive zero filter 59, the short term predictive pole filter 62 and the short term predictive zero filter 63 so that equation (6) is satisfied. For instance, the location of the long term predictive pole filter 58 and the long term predictive zero filter 59, and/or the location of the short term predictive pole filter 62 and the short term predictive zero filter 63 may be opposite to that of FIG. 4 if satisfying equation (6). Further, separate shaping factor selectors for long term predictive filters (58, 59), and short term predictive filters (62, 63) may be installed.

Generally speaking, voiced sound has a clear spectrum envelope, and in particular, a nasal sound and a word tail are close to a sinusoidal wave, herefore, they can be reproduced well, that is, the short term prediction gain is high. Further, since the voiced sound has a clear pitch structure, the long term (pitch) prediction gain is high, and the quantization noise is low.

On the other hand, a non-voiced sound, like a fricative sound, has a spectrum close to random noise, and has no clear pitch structure, so, they can not be reproduced well, that is, the long term prediction gain and the short term prediction gain are low, and the quantization noise is large.

Therefore, the quantization noise must be shaped adequately to the feature of speech by measuring the prediction gain. For example, the prediction gain may be evaluated by using $S_k/R_k$, and/or $S_kP_k$, where $S_k$ is a power of digital input speech signal, $R_k$ is a power of short term predicted residual signal, and $P_k$ is a long term predicted residual signal, $S_k/R_k$ is a power ratio of a) the speech signal before the short term prediction and b) the speech signal after it, and $S_k/P_k$ is a power ratio of a) the speech signal before total prediction and b) the speech signal after it.

The noise shaping works strongly to voiced sound which has a large value for the above ratios (that is, which has high prediction gain), and weakly to non-voiced sound which has a small value for the above ratios (that is, which has low prediction gain). The shaping factor selector 66 in FIG. 4 uses the above ratios of input to output of the predictor as the indicator of the prediction gain. In detail, the selector 66 has the threshold values $S_{th1}$, and $S_{th2}$ for $S_k/P_k$, and $S_k/R_k$, respectively, and the shaping factors $r_{ns}$ and $r_{nl}$ of the short term predictor and the long term predictor, respectively, are switched as follows.

a) When $S_k/P_k > S_{th1}$ or $S_k/R_k > S_{th2}$ is satisfied;

$$r_{ns} = r_{th1}^n,\ r_{nl} = r_{th3}^n$$

When $S_k/P_k \leqq S_{th1}$ and $S_k/P_k \leqq S_{th2}$ is satisfied;

$$r_{ns} = r_{th2}^n,\ r_{nl} = r_{th4}^n \quad (7)$$

where $0 \leqq r_{th1}^n \leqq r_{th2}^n \leqq 1$, and $0 \leqq r_{th3}^n \leqq r_{th4}^n \leqq 1$ As an alternative, LPC parameters $k_i$ (reflection coefficients) which are the output of the LPC parameter decoder 4 are used as an indicator of the prediction gain, instead of the ratios of input to output of the predictor into the shaping factor selector 66 in FIG. 4.

The prediction gain of voiced sound, nasal sound, and word tail is high, then $|k_i|$ is close to 1. On the other hand, non-voiced sound like fricative sound has a small prediction gain, then $|k_i|$ is close to 0. The parameter G which defines the prediction gain is determined as follows.

$$G = \prod_{i=1}^{N_s} (1 - k_i^2) \quad (8)$$

When the parameter G is close to 0, the prediction gain is high, and when the parameter G is close to 1, the prediction gain is low. Therefore, the noise shaping must work weakly when the parameter G is small, and strongly when the parameter G is large. In an embodiment, a threshold $G_{th1}$ is defined for the parameter G, and the shaping factors $r_{ns}$, and $r_{nl}$ of the short term predictor and the long term predictor are switched as follows.

$$\left.\begin{array}{l} a)\ \text{When } G < G_{th1} \text{ is satisfied;} \\ \quad r_{ns} = r_{th5}^n,\ r_{nl} = r_{th7}^n \\ b)\ \text{When } G_{th1} \leqq G \text{ is satisfied;} \\ \quad r_{ns} = r_{th6}^n,\ r_{nl} = r_{th8}^n \end{array}\right\} \quad (9)$$

The number of the thresholds is not restricted like above, but a plurality of threshold values may be defined, that is, the shaping factors may be switched by dividing the range of the parameters G into small ranges.

Figure 5:
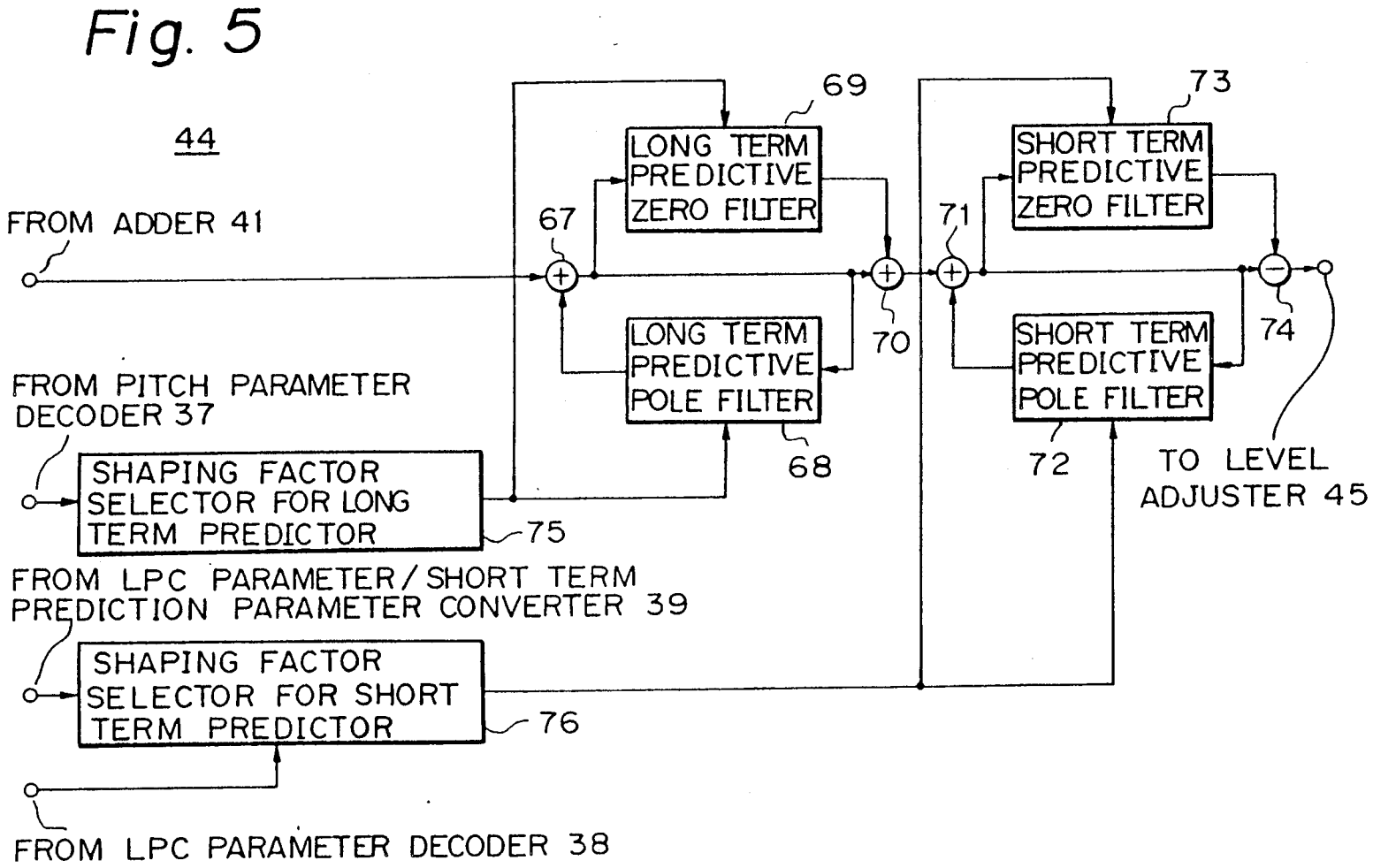
FIG. 5 is a block diagram of a post noise shaping filter for a decoder according to the present invention.

FIG. 5 is a block diagram of the post noise shaping filter 44 according to the present invention.

Figure 1B:
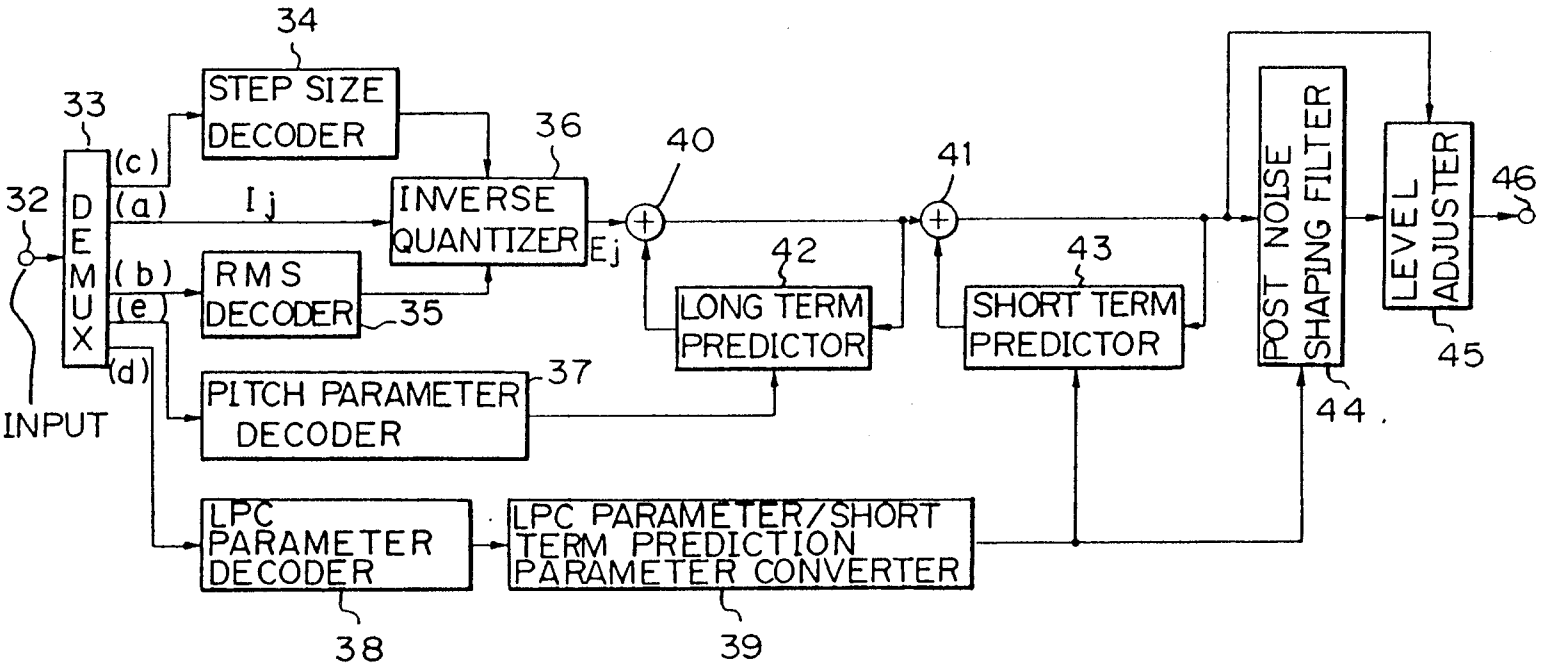
Fig. 1(b) PRIOR ART
FIG. 1B is a block diagram of a prior speech signal decoder.
Figure 2:
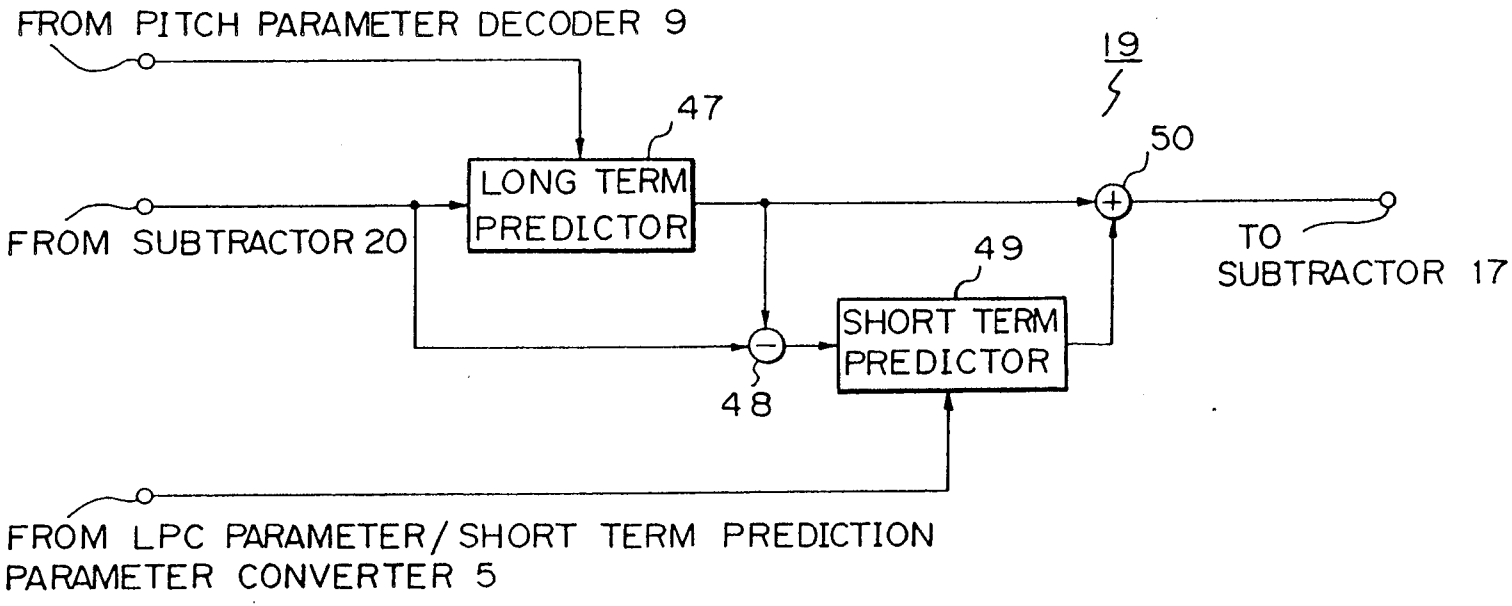
Fig. 2 PRIOR ART
FIG. 2 is a block diagram of a noise shaping filter for a prior coder.
Figure 3A:
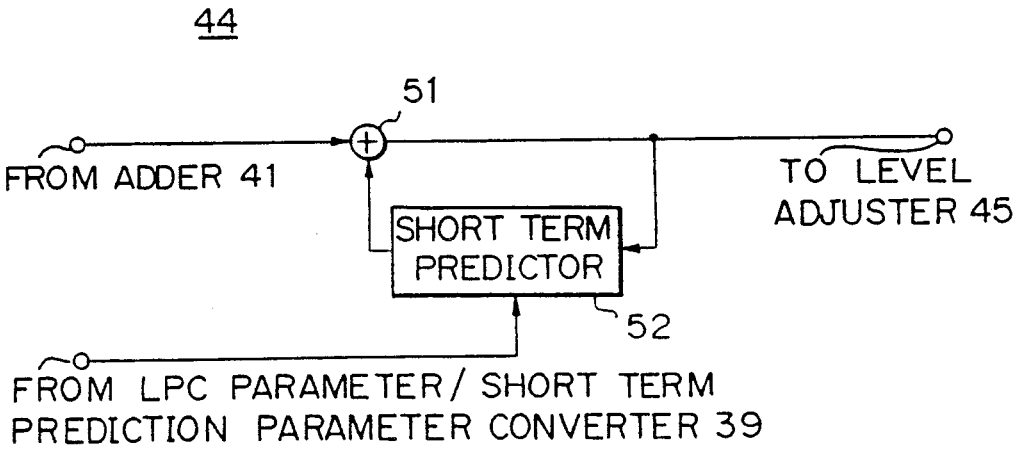
Fig. 3(a) PRIOR ART
FIG. 3A is a block diagram of a post noise shaping filter for a prior speech signal decoder.
Figure 3B:
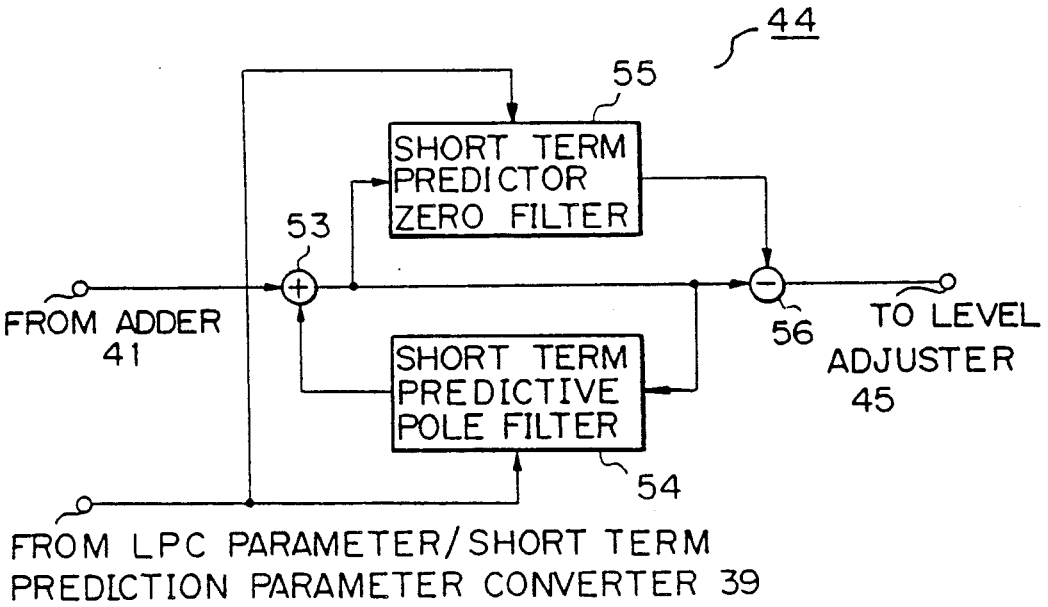
Fig. 3(b) PRIOR ART
FIG. 3B is a block diagram of another post noise shaping filter for a prior decoder.

The shaping factor selector 76 for the short term predictor evaluates the prediction gain by using the LPC parameter which is the output of the LPC parameter decoder 38 (FIG. 1B). Then, the short term prediction parameter, which is the output of the LPC parameter/short term prediction parameter converter 39, is adaptively weighted according to the evaluation, and these differently weighted short term prediction parameters are sent to the short term predictive pole filter 72 and the short term predictive zero filter 73. The shaping factor selector 75 of the long term predictor evaluates the prediction gain by using the pitch parameter which is the output of the pitch parameter decoder 37, and the pitch parameter is weighted adaptively according to the evaluation. These differently weighted pitch parameters are sent to the long term predictive pole filter 68 and the long term predictive zero filter 69. The adder 67 adds the reproduced speech signal from the subtractor 44 to the output of the long term predictive pole filter 68, and the sum is fed to the long term predictive pole filter 68 and the long term predictive zero filter 69. The adder 70 adds the output of the adder 67 to the output of the long term predictive zero filter 69, and the adder 71 adds the output of the adder 70 to the output of the short term predictive pole filter 72, and the output of the adder 72 is fed to the short term predictive pole filter 72 and the short term predictive zero filter 73. The subtractor 74 subtracts the output of the short term predictive zero filter 73 from the output of the adder 71, and the output of the subtractor 74 is fed to the level adjuster 45 (FIG. 1B) as the output of the post noise shaping filter 44.

The transfer function G(z) of the post noise shaping filter 44 including the level adjuster 45 is given below.

$$G(z) = G_0 \cdot \frac{1 - P_s(z/r_s r_{psz})}{1 - P_s(z/r_s r_{psp})} \cdot \frac{1 + r_{plz} P_1(z)}{1 - r_{plp} P_1(z)} \quad (10)$$

where $r_{psp} r_{psz}$, $r_{plp}$, and $r_{plz}$ are shaping factors of the short term predictive pole filter 72, the short term predictive zero filter 73, the long term predictive pole filter 68, and the long term predictive zero filter 69, respectively.

This short term predictor has the spectrum characteristics keeping the formant structure of the LPC spectrum, by superimposing the poles of the pole filter with the zeros of the zero filter which has less weight than that the pole filter, on the spectrum. Thus, the spectrum characteristics are emphasized in the high frequency formants as compared with the spectrum characteristics of a mere pole filter. The long term predictor has the spectrum characteristics emphasizing the pitch component on the spectrum, by locating the poles between the zeros. Thus, the insertion of the short term predictive zero filter, the long term predictive zero filter 69 and the adder 70 emphasizes the formant component of speech, in particular, the high frequency formant component, and the pitch component. Thus, clear speech can be obtained.

From the reason similar to the case of the noise shaping filter in the coder, the noise shaping must work weakly for the voiced sound where the prediction gain is high, and strongly the non-voiced sound where the prediction gain is low. For example, in the short term predictor in the post noise shaping filter using the LPC parameter $k_i$ for the spectrum envelope information, when the parameter G of the equation (8) is used as the prediction gain, the values $r_{psp}$ and $r_{psz}$ may be switched by using the thresholds $G_{th2}$ and $G_{th3}$ of the parameter G, as follows.

a) When $G < G_{th2}$ $$r_{psp} = r_{th1}^{ps},\ r_{psz} = r_{th4}^{ps}$$

b) When $G_{th2} \leqq G \leqq G_{th3}$ $$r_{psp} = r_{th2}^{ps},\ r_{psz} = r_{th5}^{ps} \quad (11)$$

c) When $G_{th3} \leqq G$ $$r_{psp} = r_{th3}^{ps},\ r_{psz} = r_{th6}^{ps}$$

where $0 \leqq G_{th2} \leqq G_{th3} \leqq 1$, $0 \leqq r_{th1}^{ps} \leqq r_{th2}^{ps} \leqq r_{th3}^{ps} \leqq 1$, $0 \leqq r_{th4}^{ps} \leqq r_{th5}^{ps} \leqq r_{th6}^{ps} \leqq 1$ As mentioned above, the switching of the shaping factors of the short term predictive pole filter 72 and the zero filter 73 provides the factors suitable to the current speech spectrum.

The similar consideration is possible for the long term predictors, that is, the use of the above equations is possible. For sake of the simplicity, an example using a one tap filter is described below.

For example, the pitch parameter $b_1$ as the prediction gain in the range of $0 < b_1 < 1$ indicates the pitch correlation, and when $b_1$ is close to 1, the pitch structure becomes clear, and the long term prediction gain becomes large. Therefore, the noise shaping must work weakly for the voiced sound which has a large value of $b_1$, and strongly for the transient sound which has a small value of $b_1$. The threshold $b_{th}$ of $b_1$ is defined, and the values $r_{plp}$ and $r_{plz}$ are switched as follows.

a) When $b_1 < b^{th}$;

$$r_{plp} = r_{th2}^{pl},\ r_{plz} = r_{th4}^{pl}$$

b) When $b_{th} \leqq b_1$;

$$r_{plp} = r_{th1}^{pl},\ r_{plz} = r_{th3}^{pl} \quad (12)$$

where $0 < b_{th} \leqq 1$, $0 \leqq r_{th1}^{pl} \leqq r_{th2}^{pl} \leqq 1$, $0 \leqq r_{th3}^{pl} \leqq r_{th4}^{pl} \leqq 1$ Similarly, the shaping factors of the long term predictive pole filter 68 and the zero filter 69 are switched to be sent the values suitable for the speech spectrum.

FIG. 5 shows using separate selectors 75 and 76. Of course, the use of a common selector as in the case of FIG. 4 is possible in the embodiment of FIG. 5.

Finally the numerical embodiment of the shaping factors which are used in the simulation for 9.6 kbps APC-MLQ (adaptive predictive coding—most likely quantization) are shown as follows.

a) When the transfer function of the noise shaping filter in the coder is expressed by equation (6), and the accuracy of the prediction is indicated by the input output ratio of the predictor (equation (7));

$$\text{If } S_k/P_k > 40 \text{ or } S_k/R_k > 30, \text{ then } r_{ns} \leqq 0.2,\ r_{nl} = 0.2$$

$$\text{If } S_k/P_k \leqq 40, \text{ and } S_k/R_k \leqq 30, \text{ then } r_{ns} \leqq 0.5,\ r_{nl} = 0.5$$

b) When the transfer function of the post noise shaping filter in the decoder is indicated by equation (10), and the short term prediction gain is expressed by the LPC parameter (equation (11));

$$G < 0.08;\ r_{psp} = 0.25,\ r_{psz} = 0.075$$

$$0.08 \leqq G < 0.4;\ r_{psp} = 0.6,\ r_{psz} = 0.18$$

$$0.4 \leqq G;\ r_{psp} = 0.9,\ r_{psz} = 0.27$$

c) When the pitch parameter (equation (12)) is used as the long term prediction gain in the post noise shaping filter;

$$b_1 < 0.4;\ r_{plp} = 0.62,\ r_{plz} = 0.31$$

$$0.4 \leqq b_1;\ r_{plp} = 0.35,\ r_{plz} = 0.175$$

As mentioned above, according to the present invention, the factors of the noise shaping filter in the coder and the post noise shaping filter in the decoder, are adaptively weighted depending on the prediction gain. Therefore, excellent speech quality can be obtained irrespective of voiced sound or non-voiced sound. The present invention is implemented simply by using the ratio of the input to the output of the predictor, the LPC parameter, or the pitch parameter as the indication of the predictor gain.

Further, in order to reduce the effect of the quantization noise the noise shaping works more powerfully by using the noise shaping filter having the shaping factor selector 66, the long time prediction pole filter 58, the zero filter 59, the short time prediction pole filter 62, and the zero filter 63.

Further, the clear speech with less quantization noise effect is provided by using the post noise shaping filter having the shaping factor selector 75, 76, the long term predictive pole filter 68 and zero filter 69, the short term predictive pole filter 72 and the zero filter 73, means for adding the input and the output of the long term predictive zero filter 69, and subtracting the output from the input of the short term predictive zero filter 73.

The present invention is beneficial, in particular, for the high efficiency speech coding/decoding system with a low bit rate.

From the foregoing, it will now be apparent that a new and improved speech coding/decoding system has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A speech coding/decoding system comprising:

a coding side including a predictor providing a prediction signal of a digital input speech signal based upon a prediction parameter which is output by a prediction parameter means, a quantizer quantizing a final residual signal input thereto and outputting a coded final residual signal, said final residual signal is a function of said prediction signal, said digital input speech signal, and a shaped quantization noise, an inverse quantizer for inverse quantization of said coded final residual signal of said quantizer, said inverse quantizer outputting a quantized final residual signal, a subtractor providing quantization noise, said quantization noise is a difference between said final residual signal and said quantized final residual signal of said inverse quantizer, a noise shaping filter shaping a spectrum of said quantization noise similar to a spectrum envelope of the digital input speech signal, said shaping of said spectrum based upon first shaping factors, said noise shaping filter outputting said shaped quantization noise, and a multiplexer for multiplexing said coded final residual signal from said quantizer, and other information determined in said coding side for sending to a decoding side, said other information including at least said prediction parameter;

said decoding side including a demultiplexer for separating said coded final residual signal, and the other information including said prediction parameter from said coding side, an inverse quantizer for inverse quantization and decoding of said coded final residual signal from said demultiplexer, said inverse quantizer outputting a quantized final predicted residual signal, a synthesis filter for reproducing said digital input speech signal by adding said quantized final predicted residual signal of said inverse quantizer and a prediction signal which is based upon said prediction parameter from said demultiplexer, and a post noise shaping filter for shaping a spectrum of a reproduced digital speech signal using second shaping factors to reduce an effect of said quantization noise on said reproduced digital speech signal, wherein the first and second shaping factors of said noise shaping filter and said post noise shaping filter vary over time with changes in the spectrum envelope in the digital input speech signal wherein said shaping factors for non-voiced sound will be larger than said shaping factors for voiced sound.

2. A speech coding/decoding system according to claim 1, wherein said first and second shaping factors vary based on a ratio of the digital input speech signal and a residual signal, which is a difference between said digital input speech signal and the prediction signal output from said predictor.

3. A speech coding/decoding system according to claim 1, wherein said first and second shaping factors vary based upon the prediction parameter which is at least one of a linear predictive coding parameter and a pitch parameter.

4. A speech coding/decoding system according to claim 1, wherein said noise shaping filter comprises:

a short term predictive pole filter and a short term predictive zero filter which shape the spectrum of the quantization noise similar to the spectrum envelope of the digital input speech signal, a long term predictive pole filter and a long term predictive zero filter which shape the spectrum of the quantization noise similar to a harmonic spectrum due to a periodicity of the digital input speech signal, a shaping factor selector for selecting said first shaping factors of said short term predictive pole filter, said short term predictive zero filter, said long term predictive pole filter and said long term predictive zero filter depending upon an elevated predication gain, a first adder receiving an output of said subtractor as an input of the noise shaping filter, and an output from said long term predictive pole filter, and providing inputs to said long term predictive zero filter and said long term predictive pole filter, a first subtractor for providing a difference between an output of said first adder and an output of said long term predictive zero filter, a second adder receiving an output from said first subtractor and an input from an output of said short term predictive pole filter, and providing inputs to said short term predictive zero filter and said short term predictive pole filter, a second subtractor for providing a difference between an output of said second adder and an output of said short term predictive zero filter, a third subtractor for providing a difference between an output of said second subtractor and an input of the noise shaping filter to provide an output of the noise shaping filter, said evaluated prediction gain being determined by evaluating said prediction parameter according to said digital input speech signal, and said prediction signal which is a difference between said digital input speech signal and said predicted signal.

5. A speech coding/decoding system according to claim 1, wherein said post noise shaping filter comprises:

a short term predictive pole filter and a short term predictive zero filter which shape the spectrum of the decoded digital speech signal similar to the spectrum envelope of the digital input speech signal, a long term predictive pole filter and a long term predictive zero filter which shape the spectrum of the decoded digital speech signal similar to a harmonic spectrum of the digital input speech signal, shaping factor selectors for selecting said second shaping factors of said short term predictive pole filter, said short term predictive zero filter, said long term predictive pole filter and said long term predictive zero filter depending upon said prediction gain, a first adder receiving an output from said synthesis filter, and an output from said long term predictive pole filter, and providing inputs to said long term predictive zero filter and said long term predictive pole filter, a second adder receiving an output of said first adder, and a output from said long term predictive zero filter, a third adder receiving an output from said second adder, and an output from said short term predictive pole filter, and providing inputs to said short term predictive zero filter and said short term predictive pole filter, and a subtractor for providing a difference between an output of said third adder and an output from said short term predictive zero filter to provide said reproduced digital speech signal.

6. A speech coding system comprising:

a predictor providing a prediction signal of a digital input speech signal based upon a prediction parameter which is output by a prediction parameter means;

a quantizer quantizing a final residual signal input thereto and outputting a coded final residual signal, said final residual signal is a function of said prediction signal, said digital input speech signal, and a shaped quantization noise;

an inverse quantizer for inverse quantization of said coded final residual signal of said quantizer, said inverse quantizer outputting a quantized final residual signal;

a subtractor providing quantization noise, said quantization noise is a difference between said final residual signal and said quantized final residual signal of said inverse quantizer; and a noise shaping filter shaping a spectrum of said quantization noise similar to a spectrum envelope of the digital input speech signal, said shaping of said spectrum based upon shaping factors, wherein the shaping factors of said noise shaping filter vary over time with changes in the spectrum envelope of the digital input speech signal wherein said shaping factors for non-voiced sound will be larger than shaping factors for voiced sound.

7. A speech coding system according to claim 6, wherein said noise shaping filter comprises;

a short term predictive pole filter and a short term predictive zero filter which shape the spectrum of the quantization noise similar to a spectrum envelope of the digital input speech signal, a long term predictive pole filter and a long term predictive zero filter which shape the spectrum of the quantization noise similar to a harmonic spectrum due to a periodicity of the digital input speech signal, and a shaping factor selector for selecting shaping factors of said short predictive pole filter, said short term predictive zero filter, said long term predictive pole filter and said long term predictive zero filter depending upon an evaluated prediction gain, a first added receiving an output of said subtractor as an input of the noise shaping filter, and an output from said long term predictive pole filter, and providing inputs to said long term predictive zero filter and said long term predictive pole filter, a first subtractor for providing a difference between an output of said first adder and an output of said long term predictive zero filter, a second adder receiving an output from said first subtractor and an input from an output of said short term predictive pole filter, and providing inputs to said short term predictive zero filter and said short term predictive pole filter, a second subtractor for providing a difference between an output of said second adder and an output of said short term predictive zero filter, a third subtractor for providing a difference between an output of said second subtractor and an input of the noise shaping filter to provide an output of the noise shaping filter, said evaluated prediction gain being determined by evaluating said prediction parameter according to said digital input speech signal, and said prediction signal which is a difference between said digital input speech signal and said predicted signal.

8. A speech decoding system comprising:

an inverse quantizer for inverse quantization and decoding of a coded final residual signal from a coding side, said inverse quantizer outputting a quantized final predicted residual signal;

a synthesis filter for decoding a digital input speech signal by adding said quantized final predicted residual signal of said inverse quantizer and a prediction signal which is a function of a prediction parameter output by a prediction parameter means; and a post noise shaping filter for shaping a decoded digital speech signal using shaping factors to reduce an effect of said quantization noise on said reproduced digital speech signal, wherein the shaping factors of said post noise shaping filter vary over time with changes in the spectrum envelope of the digital input speech signal wherein said shaping factors for non-voiced sound will be larger than shaping factors for voiced sound.

9. A speech decoding system according to claim 8, wherein said post noise shaping filter comprises;

a short term predictive pole filter and a short term predictive zero filter which shape the spectrum of the decoded digital speech signal similar to the spectrum envelope of the digital input speech signal, a long term predictive pole filter and a long term predictive zero filter which shape the spectrum of the decoded digital speech signal similar to a harmonic spectrum of the digital input speech signal, shaping factor selectors for selecting shaping factors of said short term predictive pole filter, said short term predictive zero filter, said long term predictive pole filter and said long term predictive zero filter depending upon said prediction gain, a first adder receiving an output from said synthesis filter, and an output from said long term predictive pole filter, and providing inputs to said long term predictive zero filter and said long term predictive pole filter, a second adder receiving an output of said first adder, and an output from said long term predictive zero filter, a third adder receiving an output from said second adder, and an output from said short term predictive pole filter, and providing inputs to said short term predictive zero filter and said short term predictive pole filter, and a subtractor for providing a difference between an output of said third adder and an output from said short term predictive zero filter to provide said reproduced digital speech signal.

* * * * *

UNITED STATES PATENT AND TRADEMARK OFFICE

CERTIFICATE OF CORRECTION

PATENT NO. : 5,125,030

DATED : June 23, 1992

INVENTOR(S) : Nomura, et. al.

It is certified that error appears in the above-indentified patent and that said Letters Patent is hereby corrected as shown below:

On the title page, Item [75], first line, "Yohtato" should read --Yohtaro--.

Signed and Sealed this

Seventeenth Day of August, 1993

Bruce Lehman

*Attest:*

BRUCE LEHMAN

*Attesting Officer*

*Commissioner of Patents and Trademarks*